US010991200B2

(12) United States Patent
Davis

(10) Patent No.: US 10,991,200 B2
(45) Date of Patent: Apr. 27, 2021

(54) METHOD AND SYSTEM FOR MACHINE-IMPLEMENTED GAME WITH MULTIPLE GAME INCENTIVE

(71) Applicant: BRAIN GAMES, L.C., Dallas, TX (US)

(72) Inventor: Malcolm B. Davis, Dallas, TX (US)

(73) Assignee: BRAIN GAMES, L.C., Dallas, TX (US)

( * ) Notice: Subject to any disclaimer, the term of this patent is extended or adjusted under 35 U.S.C. 154(b) by 1 day.

(21) Appl. No.: 16/234,937

(22) Filed: Dec. 28, 2018

(65) Prior Publication Data

US 2019/0139369 A1 May 9, 2019

Related U.S. Application Data

(63) Continuation of application No. 14/606,842, filed on Jan. 27, 2015, now abandoned.

(60) Provisional application No. 61/932,125, filed on Jan. 27, 2014.

(51) Int. Cl.
*G07F 17/32* (2006.01)

(52) U.S. Cl.
CPC ..... *G07F 17/3237* (2013.01); *G07F 17/3239* (2013.01); *G07F 17/3244* (2013.01); *G07F 17/3258* (2013.01); *G07F 17/3293* (2013.01); *G07F 17/322* (2013.01); *G07F 17/3241* (2013.01)

(58) Field of Classification Search
CPC ..... G07F 17/3237; G07F 17/322; G07F 17/3241; G07F 17/3258; G07F 17/3239
See application file for complete search history.

(56) References Cited

U.S. PATENT DOCUMENTS 5,275,400 A * 1/1994 Weingardt ..... A63F 3/081 273/143 R
6,142,872 A * 11/2000 Walker ..... G07F 17/32 340/323 R
6,146,271 A * 11/2000 Kadlic ..... A63F 1/00 273/292
6,244,958 B1 * 6/2001 Acres ..... G07F 17/32 463/16
7,112,138 B2 9/2006 Hedrick et al.
7,291,068 B2 * 11/2007 Bryant ..... A63F 13/12 463/25

(Continued)

*Primary Examiner* — William H McCulloch, Jr.
(74) *Attorney, Agent, or Firm* — Gregory M. Howison

(57) ABSTRACT

A method of providing a secondary skill based game to a player utilizing an electronic game machine includes providing the player with a plurality of wagering units enabling the participants to play a machine-implemented game, initiating the game whereby the player wagers during individual games, displaying indicia representing a game state to the player whereby the player may select from at least two different potentially winning actions to continue each game, determining an outcome for the machine-implemented game, and, if the number of wagering units held by the participant is greater than a predetermined number of wagering units and if the elapsed time from the initiation of the first game played by the player is less than a predetermined time interval and if the number of games played by the player is less than a predetermined maximum number of games, providing the player the a secondary skill based game prize.

14 Claims, 5 Drawing Sheets

(56) References Cited

U.S. PATENT DOCUMENTS 7,819,742 B2 * 10/2010 Chamberlain ..... G06Q 20/10 463/16
7,942,735 B2 5/2011 Meyer et al.
8,579,700 B2 * 11/2013 Davis ..... G07F 17/3276 463/22
8,715,051 B2 * 5/2014 Davis ..... G07F 17/32 463/13
8,808,077 B1 * 8/2014 Chun ..... G07F 17/3241 463/11
9,123,208 B2 9/2015 Davis et al.
9,495,838 B2 11/2016 Davis et al.
9,852,579 B2 * 12/2017 Caputo ..... G07F 17/323
2001/0031659 A1 * 10/2001 Perrie ..... A63F 3/00075 463/18
2002/0043759 A1 * 4/2002 Vancura ..... A63F 9/183 273/139
2002/0045474 A1 * 4/2002 Singer ..... G07F 17/32 463/20
2004/0133485 A1 7/2004 Schoonmaker et al.
2005/0250574 A1 11/2005 Kane et al.
2006/0205483 A1 9/2006 Meyer et al.
2006/0234796 A1 * 10/2006 Nobrega ..... G07F 17/32 463/42
2009/0131163 A1 * 5/2009 Arbogast ..... G07F 17/323 463/29
2009/0264171 A1 10/2009 Acres
2010/0121808 A1 * 5/2010 Kuhn ..... G07F 17/3276 706/50
2010/0160035 A1 6/2010 Herrmann
2011/0275432 A1 * 11/2011 Lutnick ..... G07F 17/3244 463/25
2012/0122558 A1 5/2012 Lyons et al.
2012/0135800 A1 5/2012 Acres
2012/0309481 A1 * 12/2012 Davis ..... G07F 17/3262 463/13
2014/0004923 A1 * 1/2014 Lind ..... G07F 17/3232 463/19
2014/0051520 A1 * 2/2014 Davis ..... G07F 17/3276 463/42
2014/0243063 A1 * 8/2014 Davis ..... G07F 17/3293 463/13
2014/0256402 A1 * 9/2014 Caputo ..... G07F 17/34 463/20
2014/0323199 A1 10/2014 DiMichele et al.
2015/0005059 A1 1/2015 Johnson
2015/0213690 A1 7/2015 Davis
2015/0371504 A1 12/2015 Guinn et al.
2015/0371505 A1 12/2015 Davis
2016/0093151 A1 * 3/2016 Hawkins ..... G07F 17/32 463/21
2017/0061739 A1 3/2017 Davis et al.
2017/0109963 A1 * 4/2017 Caputo ..... G07F 17/34
2019/0244480 A1 * 8/2019 Marsh ..... G07F 17/323
2019/0295380 A1 * 9/2019 Casey ..... G07F 17/3213

* cited by examiner

| | BLUE | RED |
|---|---|---|
| CARDS | ♠A ♦K | ♣5 ♣4 |
| BETTING | BLIND BET | RAISE |
| | RAISE | CALL |
| TABLE | ♣A ♣K ♣2 ♠7 ♦7 | |
| BEST HAND | ♣A ♠A ♣K ♦K ♠7 | ♣A ♣K ♣5 ♣4 ♣2 |

METHOD AND SYSTEM FOR MACHINE-IMPLEMENTED GAME WITH MULTIPLE GAME INCENTIVE

CROSS-REFERENCE TO RELATED APPLICATIONS

This application is a continuation of U.S. patent application Ser. No. 14/606,842, filed on Jan. 27, 2015, entitled METHOD AND SYSTEM FOR MACHINE-IMPLEMENTED GAME WITH MULTIPLE GAME INCENTIVE, which claims benefit of U.S. Provisional Application No. 61/932,125, filed on Jan. 27, 2014, entitled METHOD AND SYSTEM FOR MACHINE-IMPLEMENTED GAME WITH MULTIPLE GAME INCENTIVE, the contents of which are incorporated herein by reference in their entirety.

TECHNICAL FIELD

The following disclosure relates to a machine-implemented game wherein a player or a participant in a tournament may select an option allowing him or her to participate in an incentive type secondary skill based game.

SUMMARY

In one aspect, a method of providing a skill based game to participants in a simulated gaming tournament utilizes a plurality of electronic game machines. A plurality of participants are entered in the tournament and provided with a plurality of wagering units enabling the participants to participate in the tournament by playing a machine-implemented skill based tournament game on one of the electronic game machines. Participants are prompted to enter the skill based game with, for example a display screen presented on a display of the electronic game machine, in addition to the machine-implemented tournament game. Participants are entered into the secondary skill based game by paying a fee or otherwise providing value in exchange for entry into the secondary skill based game.

The machine-implemented skill based tournament game is initiated on each electronic game machine used in the tournament, with participants using the electronic game machine to participate in the tournament by placing wagers with wagering units provided to the participants. Typically, indicia representing a game state are displayed to participants with the electronic game machine which receives wagers from a participant via a user interface associated with the electronic game machine to in response to the displayed game state. An outcome for the game or, in the case of poker, hand, is determined each machine-implemented game played by each of the plurality of participants with the electronic game machines and the number of wagering units held by each participant is updated based on the outcome of each game played by the participant.

For those participants entered in the secondary skill based game, the number of wagering units held by the participant is compared to a predetermined number of wagering units, the number of hands played is compared to a predetermined maximum number and the elapsed time from the first wager by the participant is compared to a predetermined time interval. If the elapsed time is less than the predetermined time interval, the number of hands played less than the predetermined maximum and if the number of wagering units held by the participant is greater than the predetermined number of wagering units, the participant is awarded the secondary skill based prize or pot.

BRIEF DESCRIPTION OF THE DRAWINGS

For a more complete understanding, reference is now made to the following description taken in conjunction with the accompanying Drawings in which.

DETAILED DESCRIPTION

In one embodiment, a machine implemented game provides a tournament participant an opportunity to win a secondary skill based pot or prize separate from the prize or pot associated with a tournament. Alternatively, in the case of an individual playing individually against the machine implemented game, a pot or prize associated with winning a predetermined number of wagering units in individual games or hands, or a series of games or hands. In order to win the secondary skill based pot or prize, a player or participant must win a predetermined number of wagering units, typically within a predetermined number of games and a predetermined time period.

Poker games suitable for a tournament format may include Hold'em poker, five and seven card stud, Razz (a low-ball game) and similar games. One variant of Hold'em poker is "Texas Hold'em," which is widely considered one of the most strategically complex variants. Texas Hold'em utilizes a standard 52-card deck and there are typically four betting rounds. In the first round, the players are dealt two private cards. Blind bets are used to start the first round. The first player (in the position of the "small blind") typically begins the hand with a wager of a set number of wagering units and the second player (in the position of the "big blind") continues with a bet of 2X the set number of wagering units. In the case of a two-player heads-up game, the small blind is the dealer's position. In the second round (or flop), three board cards are revealed and wagers placed. In each of the third round (turn) and fourth round (river), a single board card is revealed. A fixed-bet maximum may be used, fore example with fixed raise amounts of X units in the first two rounds and Y units in the final two rounds.

Figures 1, 3:
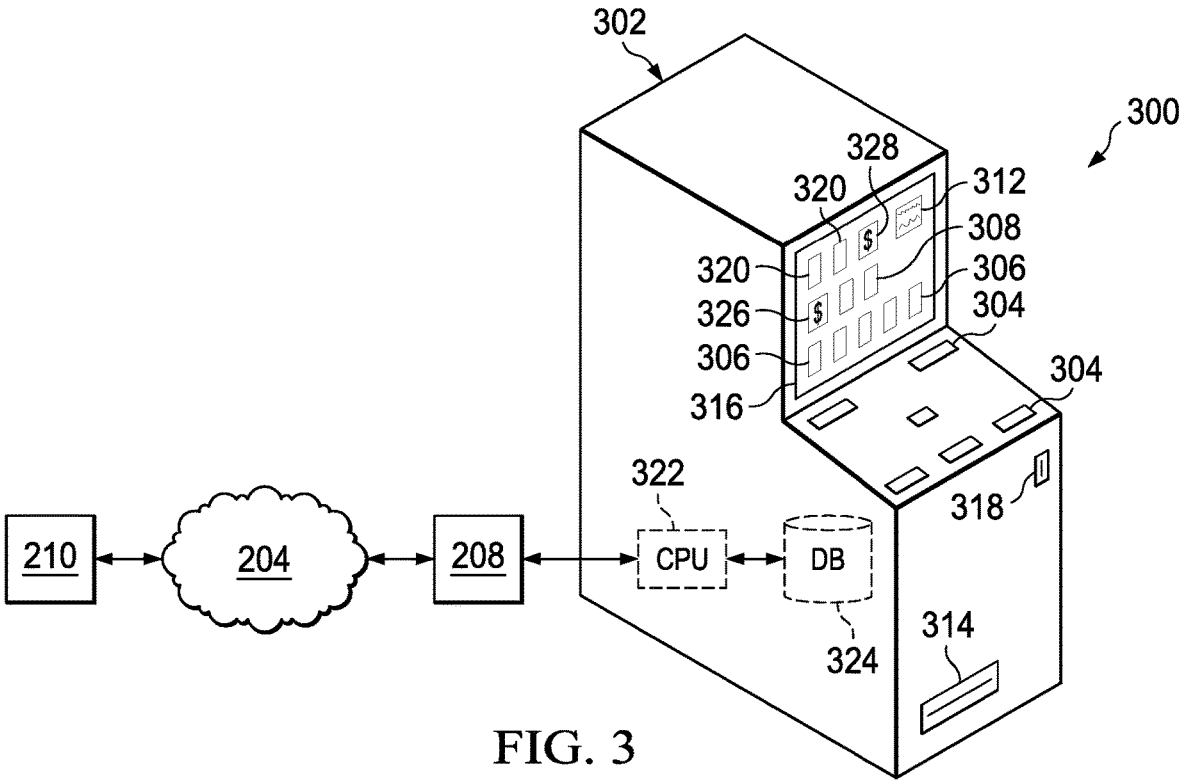
FIG. 1 is a diagram illustrating play of a hand of "Texas Hold'em" poker.
FIG. 3 is a perspective view of an electronic game machine suitable for use in connection with the system of FIG. 2.

A simplified example of a "head's up," (i.e., two player) Hold'em game suitable for adaptation as a machine implemented game may proceed as illustrated in FIG. 1. In one embodiment, the human player 'Blue" initiates play with a forced "blind" bet of one wagering unit. The "blind" may be rotated between the machine and the human player with each hand. A full deck of 52 cards is shuffled (e.g. randomly arranged) and two private cards are dealt to each player (a human player designated "Blue" and the machine implemented game designated "Red"). In the illustrated example, "Blue's" private cards are an ace of spades and a king of hearts while "Red's" private cards are a four and five of clubs. Private cards are revealed only to the player. The machine then has the options of folding, calling and raising. The betting process based on the private cards may continue until one player (the human or the machine) folds or calls. The number of raises may be limited to control the pot size and expedite the game. A player loses the pot to the opponent if he folds.

If the first round betting stops with a call, five open or community cards, called the table, are dealt in stages. The table may be dealt successively as a series of three cards ("the flop"), the two additional single cards ("the turn" and "the river.") The players may have the option to check, bet, raise or fold after each of the "flop," the "turn" and the "river" cards are dealt. Thus, the human player may select from at different potentially winning actions, (e.g. check, bet or raise) at different times or stages during the hand. The common cards are revealed to and common to the players, so that the human and the game machine each finish the hand with seven cards (two private cards and five common or public cards) from which they may choose their best five-card poker hand. The player that ends up with the better hand wins the pot. In the example illustrated in FIG. 1, the player designated as "Red" wins because the Red player's flush defeats the Blue player's two pair. Numerous variations and permutations of the game rules are possible.

In the case of a machine implemented Hold'em Poker game, a wagering unit may be equal to the small blind, e.g. the minimum bet placed when a hand is commenced. The "blind" bet may be rotated between the machine and the human player with each hand. Typically, to win the secondary skill based prize described herein, the player must accumulate a predetermined number of wagering units within a preselected time period and within a predetermined number of games or hands. As used herein the term "skill based" refers to a game, for example poker, where a participant's success depends, at least in part, upon his or her ability to play the game. While games such as poker have a large random component, e.g. randomly dealt cards, a player's success over a period of time will depend, at least in part, upon his or her ability to skillfully play a hand of randomly dealt cards. For example, some players will have a better understanding of the odds of winning with a particular hand or set of cards and play accordingly. However, it will be understood that a "skill based game" as referred to herein may, nonetheless, have a large random component.

The number of wagering units required to win the secondary skill based prize may be a fixed percentage of the total possible number of wagering units that can be won in a fixed time period and within a fixed number of hands. The total possible number of wagering units may be calculated based upon a theoretical minimum time per hand and the theoretical maximum number of wagering units that may be wagered during a hand. For example, in one embodiment where the machine-implemented game is Hold'em poker, a player may pay a $100.00 fee to buy into the tournament and receive 300 wagering units. In order to win the secondary skill based prize, the player or participant must win, for example, an additional 600 wagering units so that he or she accumulates a total of 900 wagering units before, for example he or she has played a total of 300 hands and played the 300 hands within a 45 minute time period. Numerous variations are possible, however the number of wagering units in player or participant's possession must generally reach a predetermined threshold number while he or she plays up to a predetermined number of hands within a predetermined time period. In different variations, a player of participant may be provided with an unlimited number of wagering units with which to wager. However, in this case, in order to win the secondary skill based prize, the player must still accumulate a predetermined number of wagering units as a result of his or her play within a predetermined time and number of hands.

A method that provides a secondary skill based prize or pot to a player that accumulates a predetermined number of wagering units while playing up to a predetermined number of hands with a predetermined time may be implemented in connection with a game tournament, for example, a poker tournament wherein multiple human players use the electronic game machines to play against a machine implemented game. A tournament sponsor such as a casino or other gaming entity may use a number of electronic game machines, configured to play one or more selected games to simulate tournament competition. The results of each human player's play against the machine implemented game determine the winner(s) of the tournament. The tournament sponsor may set external parameters for the tournament, including an official starting date and time, entry fee(s) or level(s), the number of hands played by individual players and other parameters. In some variations, the entry fee, a portion of which may be used to fund a prize "pot" from which prizes are awarded to winning players, may be a fixed amount, for example $100.00, $1,000.00 or $10,000.00. In other variations, players may enter at different levels with different entry fees.

For example, the casino or system owner may set minimum and maximum entry fees for example, $100.00 and $1,000.00. Tournament participants may enter for the maximum entry fee ($1000.00) or in increments equal to the minimum entry fee ($100.00). Prize "pots" may be equal to the total amount of entry fees collected minus an administrative or other fee charged by the casino or owner of the gaming system. For purposes of determining the tournament winners, the number of starting small blind credits, (wagering units) must be equal; in other words, players may enter at different levels and be eligible to participate in prize pots having differing values based on the entry fee for the pot, however, the players must begin on an equal basis in terms of wagering units. Thus, a player entering at a $1,000.00 level would receive the same number of wagering units as a player entering at a $100.00 level but would be eligible to participate in additional different prize pots.

Different prize pots may be established based upon differing entry fees. For example, a first prize pot may be established for players paying a $100.00 entry fee, a second prize pot may be established for players paying a $500.00 entry fee and a third prize pot may be created for players paying a $1,000.00 entry fee. In this embodiment, players entering at the highest level ($1,000.00) may participate in all the pots whereas participants entering at the lower levels will be eligible to participate in prize pots corresponding to the selected entry fee. Thus, a player entering at the $500.00 level would be eligible to participate only in the $100.00 and $500.00 prize pots and would not be eligible to participate in the $1,000.00 prize pot. Numerous other variations are possible.

In one variation, multiple casino (or other gaming enterprise) participation in the tournament may be implemented.

Multiple tournaments may be run concurrently and players may enter multiple times in which case the player may receive an entry identification card or slip for each entry. The identification card may be provided to the player at a casino or similar facility where the electronic game machines are located, by mail, or by means of a network, such as the internet. The gross size of the prize pot or pots may be displayed on the electronic game machines used in the tournament or other displays to encourage players to join the tournament. Alternatively, running scores for individual players may be kept confidential e.g., accessible only to the individual player so that late entrants will not know the current position of previous entrants, promoting a perception of fairness. In this regard, disclosure of an earlier entered player's randomly high position or score could tend to discourage potential players that may wish to join an ongoing tournament.

In order to fund the secondary skill based game, players who opt to participate may be required to pay an additional fee separate and apart from the tournament fee or fees. The skill based prize is typically fixed and not a function of the amount wagered by participants. In one embodiment, the fee for the skill based prize may be fixed in proportion to the size of the entry fee for that separate competition. Multiple winners of the skill based game would typically each receive the same prize, regardless of the number of participants and winners. The fee for participating in the secondary skill based game will normally be paid at the beginning of the tournament or at the time the participant enters the tournament. If a player is allowed to enter the tournament after the tournament has begun, the fee for participating in the secondary skill based game may be the same, or increased, depending upon the rules established by the tournament sponsor or operator.

In one embodiment, a player receives a fixed number wagering units upon payment of the tournament entry fee. At the time the player enters the tournament, he or she will be provided the opportunity to participate in the secondary skill based game for an additional fee. The player may use the credits or wagering units to participate in the tournament, for as long as he or she wishes, (subject to external parameters such a pre-set end time) or until the player exhausts their credit(s). In one variation, a player may enter the tournament an unlimited number of times subject to external parameters such as pre-set end time times and/or a predetermined cutoff date and time for entry. Players may enter multiple times, and/or play simultaneous positions corresponding to each entry and at the completion of the tournament, or when the player withdraws from the tournament, the player may have a separate result for each entry. In one embodiment, the secondary skill based game may be incorporated into the tournament, e.g., all tournament participants are included in the secondary skill based game. However, a player who enters multiple times in the tournament will not be allowed to accumulate or aggregate his or her results from the different entries for the purpose of the skill based prize.

A tournament may continue for a predetermined time period, for example, four hours, twelve hours or longer, for example one, three or five days. When the tournament is completed, the player who has accumulated the largest number of small blind credits or wagering units wins a tournament first or grand prize as determined by the tournament rules. Lesser prizes may be awarded to players finishing in different tournament positions, e.g., second, third, fourth place, on a sliding scale depending upon the rules of the particular tournament. Proportionately reduced prizes may be awarded based on entry fees less than the maximum entry fees. For example, players who enter at higher levels may qualify for larger portions of the prize pot or amounts in segregated pots corresponding to increased entry fees.

An award of the secondary skill based prize is made independently from the award of the tournament prizes based upon finishing position. For example, a player may enter the tournament; pay the fee to participate in the secondary skill based game and win a predetermined number of wagering units within the predetermined time and number of hands to qualify for the secondary skill based prize. In this case, the player is eligible to win the secondary skill based prize even if he or she ultimately exhausts his or her credit(s) or fails to win enough wagering units to be eligible for a tournament prize based upon his or her accumulated wagering units at the conclusion of the tournament. Thus, a player may win and collect a secondary skill based prize prior to the end of the tournament.

Figure 2:
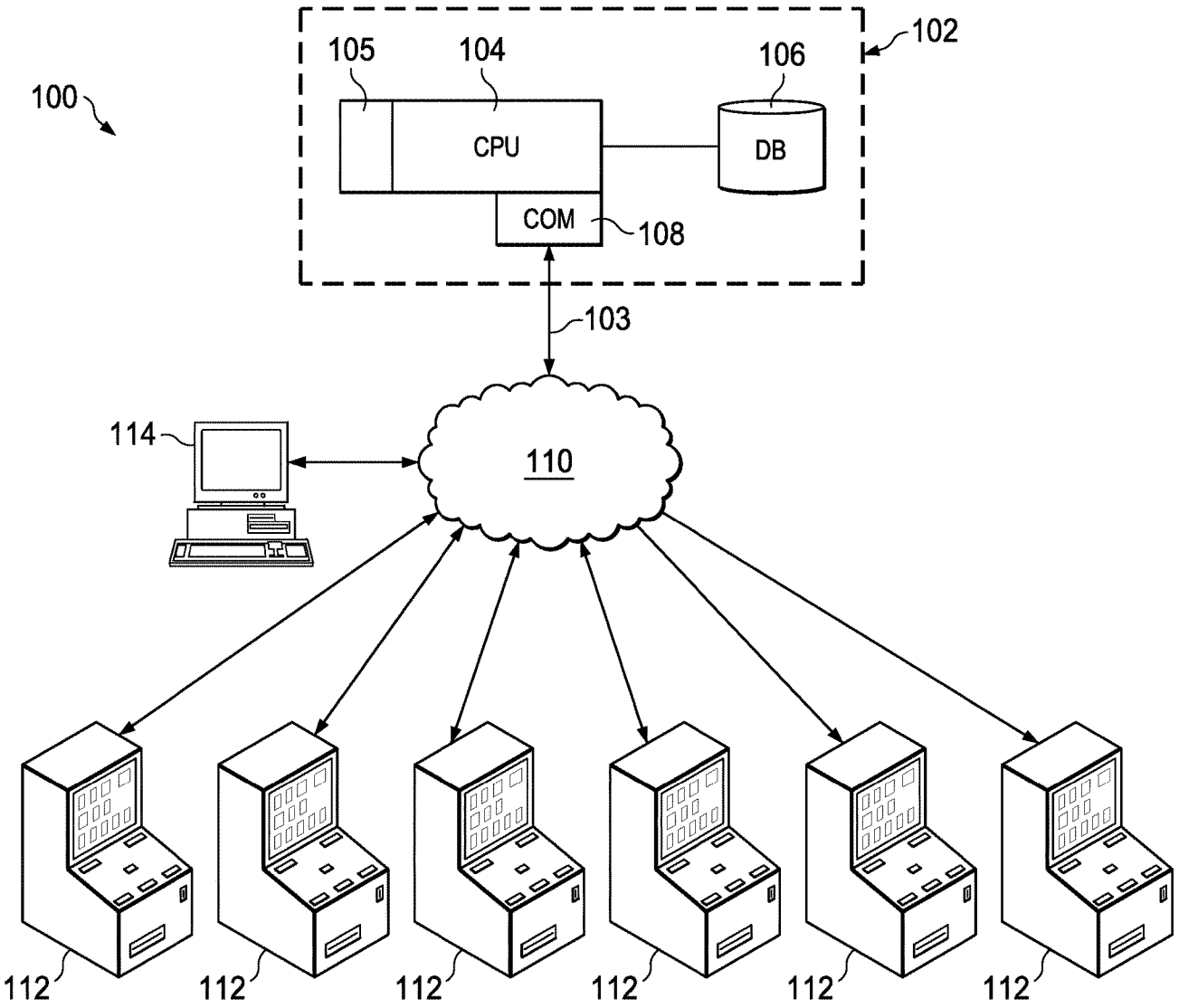
FIG. 2 is a schematic representation of a system for implanting an electronic machine-based game tournament.

FIG. 2 is a schematic representation of a system for implementing a machine-implemented game and/or tournament in which a secondary skill based game as described herein may be implemented. As illustrated, system 100 may include a central office 102. Central office 102 may include a processor having a CPU 104 including an associated data storage unit 106 and a communications interface 108. Central office 102 may communicate via a data link 103 with a network 110, which in turn enables communications between the central office 102 and one or more game machines 112. Network 110 may be a private hard-wired network such as a LAN, a private wireless network and/or a public network such as the Internet in which case the machine-implemented game may be played with user devices having Internet access. Central office 102 may also communicate via network 110 with an administrative terminal 114 for accounting and/or monitoring game machines 112 from a local or remote location. It will be appreciated that the system may be used in connection with game machines at different locations and may be implemented in the form of a network game whereby users may access and play the game via a private network or a public network such as the Internet.

CPU 104 may download games or similar information stored on data storage unit 106 via data link 103 and network 110 to game machines 112. CPU 104 of central office 102 may also upload information from game machines 112 via network 110 and data link 103. CPU 104 may also provide monitoring functions for monitoring the activity on game machines 112 in realtime or at periodic intervals. In one embodiment, CPU 104 implements one or more game engines schematically represented as 105 for controlling and monitoring games played by patrons on game machines 112. In some embodiments, games played on game machines 112 that implement a skill based game feature will be part of a symmetric game portfolio, in which the game machine and the human player play by the same rules, and wherein the game machine makes strategic decisions determined by artificial intelligence. For example, actions by the game machine may be determined with an algorithm based on the different probabilities associated with the particular game state at that time. In different variations, a random component may be incorporated into such an algorithm or game engine to simulate bluffing and/or to prevent predictable play on the part of the algorithm or game engine.

FIG. 3, is illustrated a diagrammatic view of an electronic game machine 300, similar or identical to machines 112 of FIG. 2, suitable for use in a system and method for implementing a machine-based tournament. Machine 300 includes a chassis 302 for mounting a display 316 and one or more user interfaces 304 that allows a human user to interact with the system to participate in a tournament. User interfaces 304 may include features similar to a graphical touch screen, keyboard, buttons, levers, or switches that enable the user to play games using game machine 300. Display 316 may further comprise a graphical user interface, providing one or more additional user interfaces. User input will typically be based on a decision to take an action. In the case of a machine-implemented poker game, the action may be to place a bet, raise, call/check or fold.

A payment input device 314 allows a user to input a credit card, debit card, smart card, bar coded ticket or other stored value card or token to pay the entry fee for the tournament. Alternatively, payment input device 314 may be a currency reader. In one embodiment, machine 300 may include a cash, ticket or token dispenser 318 to make cash payments or dispense tokens or tickets to the user. In one embodiment, a stored value card is used to record and store a player's position, e.g. the number of wagering units available to the player in a tournament, thereby enabling a player to enter, leave and re-enter the tournament by removing or inserting the card into a machine 300. It is anticipated that a player will have a separate stored value card or the equivalent, or at least separate account, for each separate entry in the tournament if the player enters the tournament multiple times.

Display 316 provides a human player one interface with the electronic game machine, i.e., it displays an indicia representative of a game state, for example, a simulation of the cards in play. By way of example, in accordance with a machine-implemented simplified heads up Texas Hold'em game as described in connection with FIG. 1, the display may show the human player's two private cards 308. The human user's private cards 308 will be displayed to the user, but the game itself has no access to the human's private cards. The game's private cards 320 will appear to the user on display 316 as if the cards were turned down, but electronic game machine 300 will have access to the information associated therewith. Community cards 306 will be displayed to the human user and will be known by machine 300. During play, the human player may select various actions, i.e., bet, raise, fold, check or call, at different times, using user interface devices 304. As the game progresses, indicia representative of the game state, for example some or all of the cards in play and/or held by player and the number of wagering units held by the player(s) are updated and displayed with display 316. The number of hands played by a player along with the elapsed time since initiation of the player first hand or wager may also be displayed. During tournament play, the game states of the different players may also be displayed to a viewing audience.

Thus, in one embodiment, a player's position, e.g., the number of small blind credits or wagering units available to the player may be presented on display 316. If a player elects to participate in a secondary skill based game as described herein, that player's position relative to a winning position may be displayed. For example, if a player needs to accumulate a total of 900 wagering units while playing up to 300 hands within a 45 minute period to win the secondary skill based prize, the display may include the player's accumulated wagering units, the number of hands the player has played, and the elapsed time and/or the number of hands and time remaining in which the player must accumulate the required number of wagering units to win the secondary skill based prize.

Additionally, the prize pot or pots 326 associated with a tournament may also be presented on display 316 to simulate interest in the tournament. The player's position and the size of the prize pot or pots 326 may be continuously or periodically updated as the tournament progresses. Other information 312, for example the duration of the tournament and/or the remaining time or hands to be played in the tournament may also be displayed if the tournament is time limited or by the number of hands a participant may play.

In one embodiment, game machine 300 has a dedicated processor 322 or "brain" and an associated database 324 operatively connected to the processor. In this embodiment, game machine 300 is a stand-alone unit that may be monitored by central office 102 to monitor the player's results during the tournament and for audit and accounting purposes. Different machine-implemented games, suitable for a tournament, may be down loaded from central office 102 to processor 322 and/or stored on database 324, enabling electronic game machine 300 to play selected games on a stand alone basis. In other variations, the operation of game machines 300 may be directly controlled by central office 102 during play.

In different embodiments, game machine 300 may be a "dumb" machine, i.e., controlled on a real time basis by central office 102. In this embodiment, instructions and programs for executing a game may be performed using CPU 104 of central office 102 in response to input by a player utilizing user interface(s) 304. In other words, a machine-implemented-game is actually played by CPU 104 on a real time basis rather than by game machine 300. In this embodiment, game results, statistics and disbursements may be reported on a real time basis, at periodic intervals or at the end of each game played to central office 102. In yet other variations, instructions and programs for playing a game on game machine 112 may be executed in part on the game machine and in part by CPU 104 of central office 102.

Figure 4:
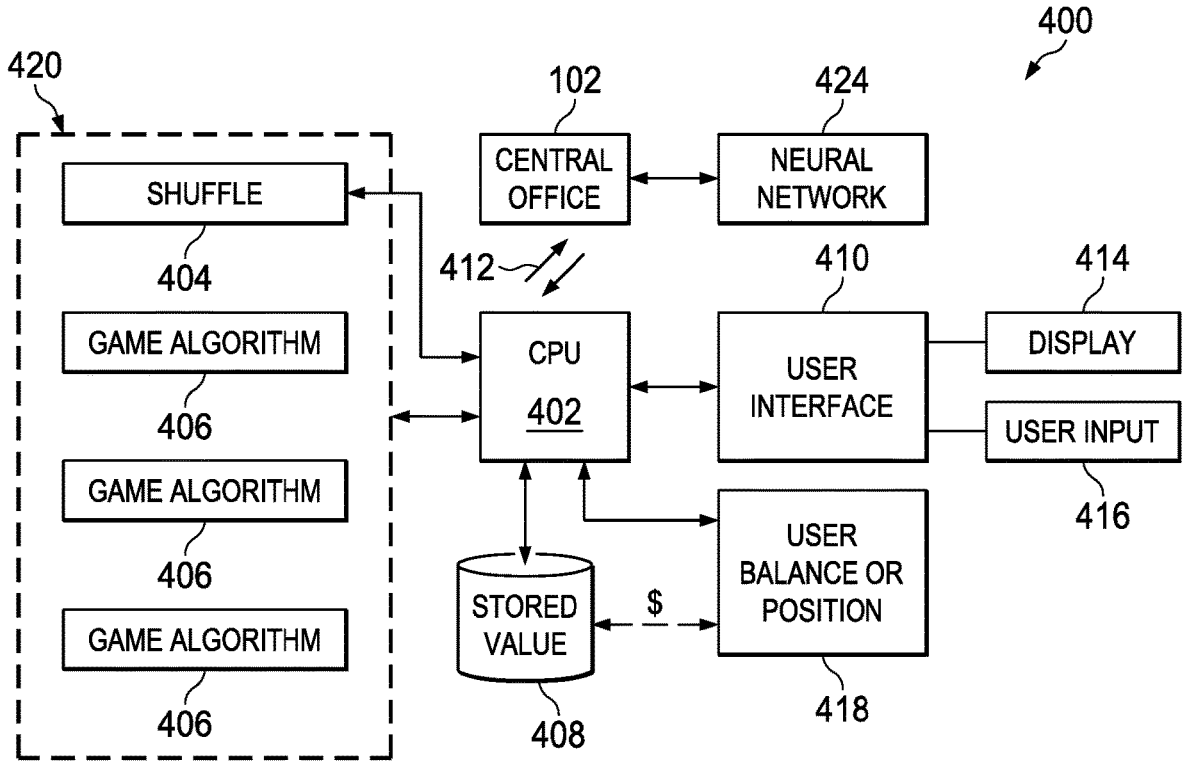
FIG. 4 is a block diagram further illustrating one embodiment of a system for controlling an electronic game machine.

FIG. 4 is a block diagram schematically illustrating one configuration of an electronic game system 400 that may be implemented on a game machine such as machine 300 of FIG. 3. As illustrated, a plurality of algorithms such as a shuffle algorithm 404 and game algorithms 406, corresponding to different games and actions available on the machine, are stored on data base 420. Processor 402 may access the different algorithms 404, 406 in response to user input 416 received via user interface or interfaces 410 to take various actions. Such actions may be in response to an action by a human player during play.

Processor 402 may interface with a stored value module 408 such as a magnetic card read/write module for maintaining and updating the player's position 418 on a stored value card or similar device. This enables a player to leave the tournament by removing the stored value card and to resume play continuing the previous session by inserting the card in module 408. As a tournament progresses and a participant plays more hands, his or her position, i.e., the number of small blind credits or wagering units in the player's possession will increase or decrease depending on the outcome of the hands the participant plays against the machine-implement game. Processor 402 maintains a record of the player's position 418, debiting or crediting the number of small blind credits available to the player and storing the player's position on stored value module 408. Typically however, once a player has submitted his result to the tournament administrator for a given entry, he may no longer continue that session, but may reenter by paying another fee.

Processor 402 may communicate the player's identity, the player's position, the identity and status of the game in play and other information to central office 102, continuously or at periodic intervals, via a data interface represented by arrows 412. In an embodiment where the tournament is played via a public or private network, the machine-implement game may be played with a personal communications device such as a personal computer, smart phone, tablet computer or similar device. In this case, electronic game system 400 may be partially or completely resident on central office 102 and data transfer between the central office and the personal communications device will take place over the public or private network. At the conclusion of the tournament, central office 102 compares the results, e.g., the number of small blind credits or wagering units accumulated by each participant, to determine one or more winners of the tournament.

In one embodiment, processor 402 is operable to execute a game algorithm 406 which plays a selected game, for example a Hold'em poker game. Processor 402 may interface with and uses one or more neural networks 424 along with a selected game algorithm 406. The output of neural networks 424 may be a probability distribution for certain actions, i.e., there are a number of actions associated with a neural network each of which have a probability distribution associated therewith. The neural networks may be "trained" to associate the probabilities of different outcomes based on particular game states. The probability distribution(s) may be used to determine actions that may be taken by system 400 during play, e.g. in the case of a poker game, to fold, call/check or raise. Game algorithm(s) 406 may be designed to introduce a random component or factor in order to prevent predictable responses on the part of the game and/or to simulate "bluffing".

Referring still to FIG. 4, different games will also have associated therewith some type of "shuffle" algorithm or program 404 that will shuffle, i.e., randomly arrange the cards. Shuffle algorithm 404 may use a random or pseudo-random number generator to simulate a shuffle of a 52-card deck and select cards for the game. As previously noted, game algorithms 406 may rely on one or more neural networks 424 to enable system 400 to play the corresponding game, including a random number generator to introduce a random factor.

Figure 5:
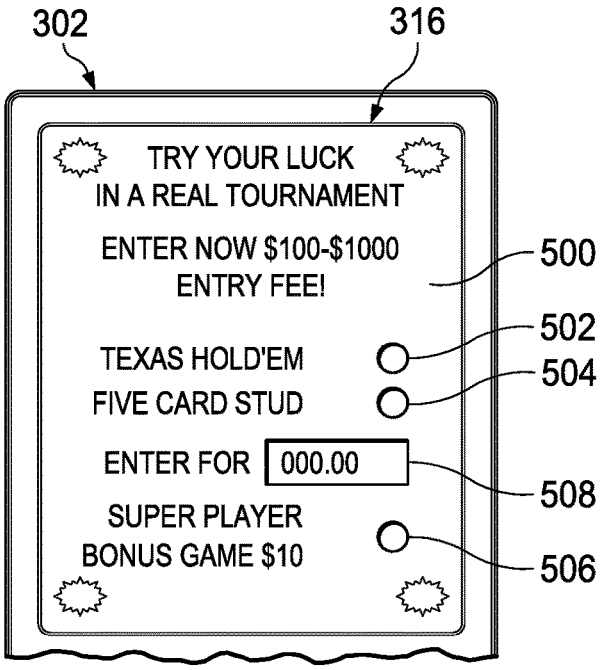
FIG. 5 is a partial view of on screen display for prompting a potential participant in a tournament implemented with electronic game machines.

FIG. 5 is an exemplary screen display 500 that may be presented to a player via display 316 of game machine 300 (FIG. 3). Display screen 316 may comprise a touch screen or similar interface with screen display 500 prompting potential tournament participants to enter a machine based tournament. Screen display 500 may include buttons 502 and 504 allowing a potential tournament participant to enter a machine based tournament in which the machine-implemented game is Texas Hold'em or Five Card Stud, respectively. Screen display 500 may also include a prompt encouraging a potential tournament participant to enter a "Super Player Bonus" skill based secondary game using "button" 506 that enables a player to select the secondary skill based game in connection with a selected tournament. Screen display 500 may also include a field 508 for allowing participants to enter the tournament for varying amounts. If game machine 300 is not equipped with a touch screen display or similar graphical user interface, the player may select the "Super Player Bonus" option by means of buttons 304 of game machine 300.

Figure 6:
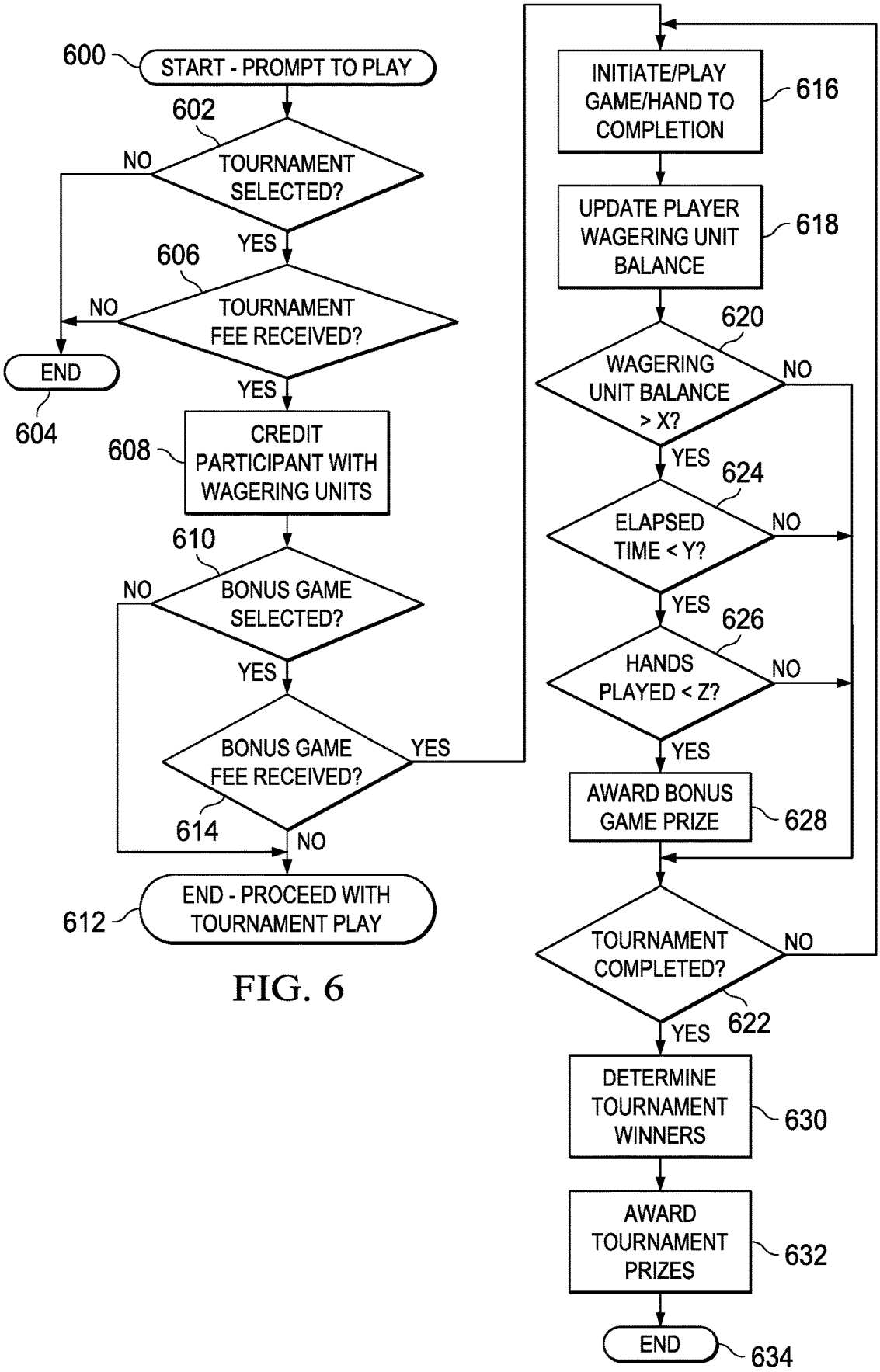
FIG. 6 is a flow diagram illustrating one method of providing a secondary, skill based game according to the disclosure.

FIG. 6 is a flowchart illustrating one method of implementing a secondary skill based game as disclosed herein. The process begins at step 600, with an electronic game machine prompting potential tournament participants to play a machine-implemented game or games. Players and prospective players may also be prompted to enter a tournament. At step 602, a participant may elect to enter the tournament and pay the entry fee at step 606. If a tournament is not selected, or if the tournament entry fee is not paid, the process ends at 604.

If the tournament entry fee is paid, the tournament participant's account is credited with wagering units at step 608. As previously noted, in some variations, a participant may enter a tournament for different amounts; however, all participants will typically be provided with the same number of wagering units. At step 614, a participant may be prompted and elect to participate in a secondary skill based game by paying an additional fee, separate from the tournament entry fee. If a tournament participant elects not to participate in the secondary skill based game or fails to pay the required fee, the process ends at step 612 and the participant may continue with tournament play.

At step 616 tournament play is initiated and, in the case of an electronic poker game, a hand is dealt and played as described, for example, in connection with FIG. 1. After the hand is played to completion the tournament participant's wagering unit balance is updated at step 618. If the tournament participant has elected to take part in the secondary skill based game, at step 620 his or her wagering unit balance X is compared to a predetermined number of wagering units, for example 900, required to win the secondary skill based prize. If the tournament participant has acquired the required number of wagering units, the elapsed time, from the first hand dealt after the participant elected the secondary skill based game, is compared to a predetermined time Y, for example 45 minutes at step 624. If the tournament participant has accumulated the predetermined number of wagering units within the predetermined time, at step 626 the number of hands Z that the participant has played is compared to the predetermined maximum number of hands allowed in which to acquire the predetermined number of wagering units. If the tournament participant has accumulated the required number of wagering units within the required time period and within the predetermined number of hands, the participant is awarded the secondary skill based pot or prize at step 628. If the participant has not acquired the required predetermined number of wagering units or if the elapsed time was greater than the predetermined time limit, the process proceeds to step 622. If the tournament has not been completed, the process returns to step 616 and the next hand is dealt. Alternatively, if the tournament is complete, at step 630 the tournament winner(s) are determined. The tournament prizes may then be awarded at step 632 and the process ends at step 634.

In another variation, a tournament participant may be afforded an opportunity to enter the secondary skill based game after the tournament has begun, assuming that there is sufficient time remaining in the tournament to enable the participant to complete the game. For example, if the predetermined time in which the participant must accumulate the predetermined number of wagering units is thirty minutes, the participant must enter the tournament at least 30 minutes before the tournament is concluded. In this variation, the player will still be required to accumulate the predetermined number of wagering units, starting with the first hand dealt after he or she elects to participate in the secondary skill based game, within the predetermined time period and number of games. In yet another embodiment, a player may pay a fee to participate on a limited basis, participating only in the skill based game. In this embodiment, the player would not be eligible to win any portion of the tournament pot(s) or prize(s).

Figure 7:
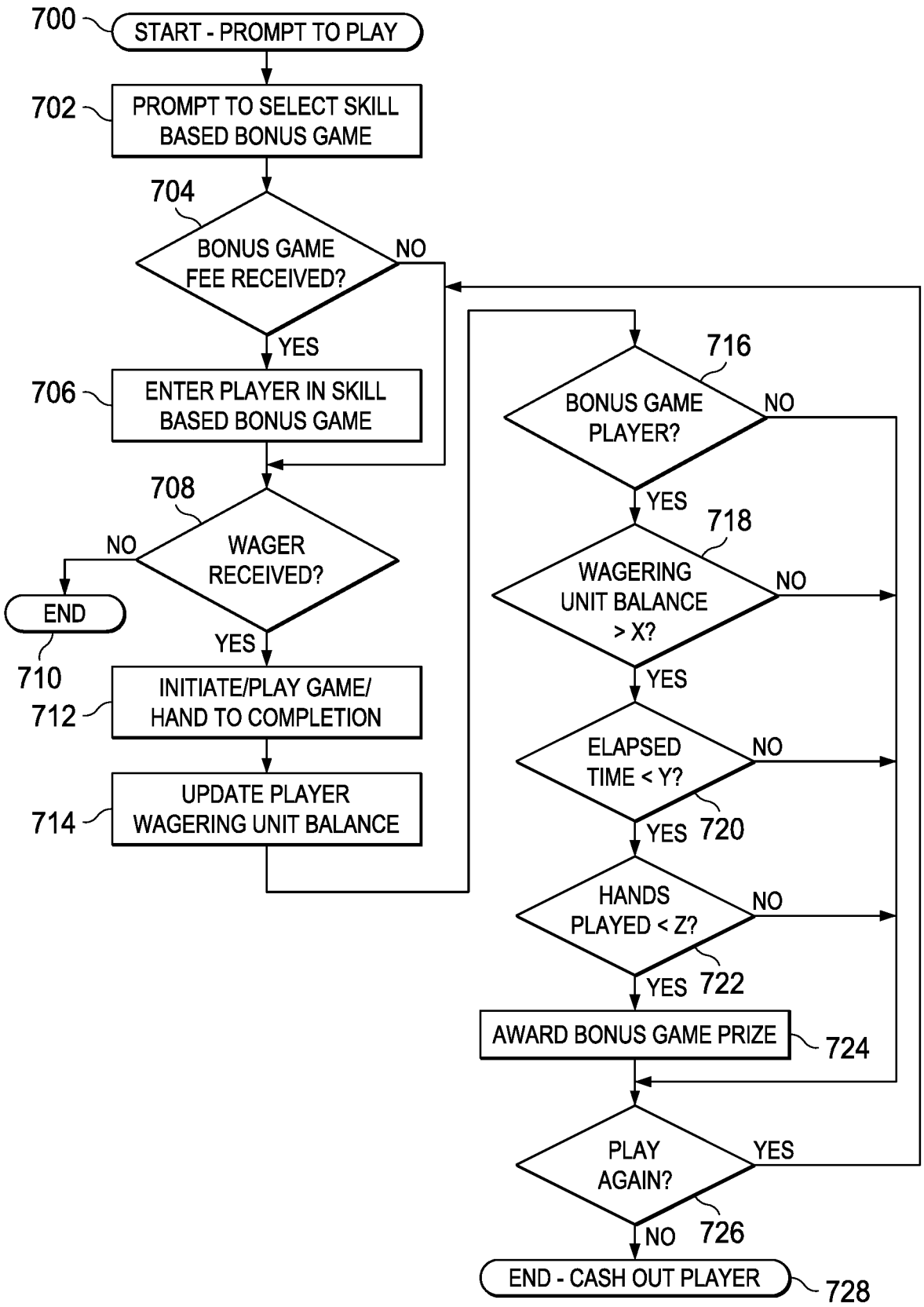
FIG. 7 is a flow diagram illustrating a second method of providing a secondary, skill based game according to the disclosure.

Referring to FIG. 7, while the award of a secondary, skill based prize or pot has been described in connection with tournament play, it may be implemented in connection with individual play. As illustrated, at 700, an electronic game machine prompts, for example by means of a display, a player to play a machine-implemented game, for example poker. At 702 the player is prompted to enter a skill based secondary game conducted as the player plays multiple individual games or hands. If the player elects to play the secondary skill based game, and pays the fee for the game at 704, he or she is enter in and becomes eligible to win the secondary skill based game at 706. Regardless of whether the player elects to play the secondary skill based game, the process moves to step 708 where to the player may initiate a game or hand with a wager. If the player fails to wager, the process ends at 710.

At 712 play is initiated and the game or hand is played to completion, after which the player's wagering unit balance is updated at step 714. At step 716, a check is made to determine if the player entered the secondary skill based game. If the player entered the game by paying the fee for the game at 704, the player's wagering unit balance is checked at 718 to determine if he or she has accumulated enough wagering units X to be eligible for the secondary skill based prize. For example, a player starting with 300 wagering units may be required to accumulate 600 additional wagering units for a total balance of 900 wagering units or greater. If the player has accumulated the required number of wagering units, at step 720 the elapsed time is compared to a predetermined maxim Y and at step 722 the number of hands played is compared to a maximum predetermined Z of hands.

If the player has accumulated the required number of wagering units X within the predetermined time Y and maximum number of hands Z, the player is awarded the prize for the secondary skill based game at 724. At step 726, the player decides whether or not to continue play. If the player elects to continue play at 726, the process loops to 708 and a new game or hand is initiated. Alternatively, if the player decides not to continue, he or she may be cashed out at 728 if the player has a wagering unit balance.

In the embodiments described in connection with FIG. 7, a player wagers during each hand or individual game and may win, based on the outcome of individual hands, regardless of whether he or she wins the secondary skill based game. In yet another embodiment, a player may wager solely on the outcome of the secondary skill based game. In this embodiment, the player is still provided with wagering units when he or she initiates play, however a prize is awarded only if he or she accumulates a predetermined threshold number of wagering units within a predetermined time and number of hands. In this embodiment, the player does not receive a payout for winning individual hands and play is terminated if the player fails to accumulate the predetermined threshold number of wagering units within a predetermined time and number of hands with the player receiving no award or prize, regardless of the outcome of individual hands or games.

Although the preferred embodiment has been described in detail, it should be understood that various changes, substitutions and alterations can be made therein without departing from the spirit and scope of the invention as defined by the appended claims.

What is claimed is:

1. A method of providing a secondary skill based game to participants in a simulated gaming tournament utilizing a plurality of electronic game machines, the method comprising:

a) receiving, by a central office processor, tournament fees transmitted over a network from the plurality of electronic game machines and entering a plurality of participants associated with the plurality of electronic game machines in the simulated game tournament, wherein differing tournament fees qualify a participant to participate in differing prize pots, and providing each participant with a plurality of wagering units in exchange for the tournament fee enabling the participants to participate in the simulated game tournament by playing a machine-implemented skill based game on one of the electronic game machines, the participants each being provided a same number of wagering units;

b) prompting, on a display screen of at least one of the plurality of electronic game machines, at least one participant to enter the secondary skill based game in addition to the machine-implemented skill based game, whereby a winner of the secondary skill based game may be awarded a secondary skill based prize;

c) receiving, by the central office processor, an additional fee transmitted over the network from at least one of the plurality of electronic game machines, whereby the at least one participant is entered into the secondary skill based game;

d) initiating the machine-implemented skill based game on the electronic game machines whereby participants may play the machine-implemented skill based game using one or more user interfaces of the electronic game machines by placing wagers with wagering units;

e) displaying indicia representing a game state on the display screens of the electronic game machines to each participant in the simulated game tournament, whereby a participant may select from at least two different potentially winning actions to continue the machine-implemented skill based game using the one or more user interfaces of the electronic game machines;

f) receiving, by the central office processor, a wager transmitted over the network from a participant via the one or more user interfaces of one of the plurality of electronic game machines in response to the game state displayed to the participant, the participant using wagering units to place the wager;

g) determining, by the central office processor, an outcome for each machine-implemented skill based game played by each of the plurality of participants with the plurality of electronic game machines, based on information uploaded to the central office processor by each of the plurality of electronic game machines, wherein determining the outcome includes:

interfacing with a neural network trained to associate probabilities of different outcomes based on the game state, receiving, from the neural network, one or more game actions based on the probabilities of the different outcomes, and selecting a game action to perform from the one or more game actions based on a random factor;

h) updating, by the central office processor, a number of wagering units held by each participant based upon each outcome determined in step g);

i) determining each participant entered in the secondary skill based game based on ones or more responses to the prompting of the at least one participant to enter the secondary skill based game;

j) for each participant entered in the secondary skill based game, comparing, by the central office processor, the number of wagering units held by the participant to a predetermined number of wagering units;

k) for each participant entered in the secondary skill based game, determining, by the central office processor, an elapsed time that each participant has played the secondary skill based game;

i) if the elapsed time is less than a predetermined time interval, and ii) if the number of wagering units held by the participant is greater than the predetermined number of wagering units, providing the participant a secondary skill based prize;

l) repeating steps d)-k) for a duration of the simulated game tournament; and m) comparing, by the central office processor, the number of wagering units held by each participant at completion of the simulated game tournament and determining one or more winners of the simulated game tournament.

2. The method of claim 1 further comprising comparing a number of machine-implemented games played by the participant to a predetermined number of games and i) if the elapsed time is less than the predetermined time interval, ii) if the number of machine-implemented games is less than the predetermined number of games, and iii) if the number of wagering units held by the participant is greater than the predetermined number of wagering units, providing the participant a secondary skill based prize, providing the participant a secondary skill based prize.

3. The method of claim 1 wherein the machine-implemented skill based game is poker.

4. The method of claim 1 wherein the machine-implemented skill based game is Texas Hold'em poker.

5. The method of claim 1 further comprising for each participant entered in the secondary skill based game, displaying the number of wagering units held by the participant after each machine-implemented game.

6. The method of claim 5 further comprising for each participant entered in the secondary skill based game, displaying the elapsed time that the participant has played the secondary skill based game after each machine-implemented game.

7. The method of claim 6 further comprising, for each participant entered in the secondary skill based game, displaying a number of machine-implemented games played by the participant and the elapsed time that each participant has played the secondary skill based game after each machine-implemented game.

8. A method of providing a secondary skill based game to a player utilizing an electronic game machine, the method comprising:

a) providing, by a central office processor, the player with a plurality of wagering units in exchange for value received from the player transmitted over a network to the central office processor from the electronic game machine, enabling the player to play a machine-implemented game on the electronic game machine, using wagering units to place wagers;

b) prompting, by a display on the electronic game machine, the player to enter the secondary skill based game in addition to the machine-implemented game, whereby the player may be awarded a secondary skill based prize;

c) receiving, by the central office processor, a fee from the player transmitted from the electronic game machine to the central office processor, whereby the player is entered into the secondary skill based game;

d) initiating the machine-implemented game on the electronic game machine, whereby the player wagers during individual machine-implemented games using the electronic game machine;

e) displaying, on the display of the electronic game machine, indicia representing a game state with the electronic game machine whereby the player may select from at least two different potentially winning actions to continue the machine-implemented game;

f) determining, by the central office processor, an outcome for the machine-implemented game played by the player using the electronic game machine, based on information uploaded to the central office processor by the electronic game machine wherein determining the outcome includes:

interfacing with a neural network trained to associate probabilities of different outcomes based on the game state, receiving, from the neural network, one or more game actions based on the probabilities of the different outcomes, and selecting a game action to perform from the one or more game actions based on a random factor;

g) updating, by the central office processor, a number of wagering units held by the player based upon each outcome determined in step f);

h) determining that the player entered the secondary skill based game based on one or more responses to the prompting of the player to enter the secondary skill based game;

i) comparing, by the central office processor, the number of wagering units held by the player to a predetermined number of wagering units;

j) determining, by the central office processor, an elapsed time from the initiation of a first machine-implemented game played by the player and comparing the elapsed time to a predetermined time interval;

k) comparing, by the central office processor, a number of machine-implemented games played by the player to a predetermined maximum number of games; and i) if the number of wagering units held by the player is greater than the predetermined number of wagering units, and ii) if the elapsed time from the initiation of the first machine-implemented game played by the player is less than the predetermined time interval, and iii) if the number of machine-implemented games played by the player is less than a predetermined maximum number of games, then providing the player a secondary skill based prize.

9. The method of claim 8 wherein the machine-implemented game is poker.

10. The method of claim 8 wherein the machine-implemented game is Texas Hold'em poker.

11. The method of claim 8 further comprising displaying the number of wagering units held by the player after each machine-implemented game.

12. The method of claim 8 further comprising, for each participant entered in the secondary skill based game, displaying the elapsed time from a first wager by the participant after each machine-implemented game.

13. The method of claim 8 further comprising, for each participant entered in the secondary skill based game, displaying the number of machine-implemented games played by the participant in the elapsed time after each machine-implemented game.

14. A system for providing electronic games, the system comprising:

a plurality of game machines, wherein each one of the plurality of game machines includes:

a chassis, a dedicated processor configured to receive downloaded information on a plurality of games, a display mounted in the chassis configured to display information regarding the plurality of games, one or more user interfaces mounted in the chassis including at least one of a graphical touch screen, a keyboard, buttons, levers, or switches configured to receive user inputs associated with the plurality of games, and a payment input device mounted in the chassis, wherein the payment input device is configured to accept tournament fees and wagering units from players for use in the plurality of games; and a central office processor coupled to a communications interface and a data storage unit, wherein the central office processor is configured to:

retrieve information on the plurality of games from the data storage unit, wherein the plurality of games includes a skill-based game and a secondary skill-based game, transmit, via the communications interface over a network, information regarding the skill-based game to the plurality of game machines, receive, via the communications interface over the network from the plurality of game machines, player actions received via the one or more user interfaces of each of the plurality of game machines, and other game updates, transmit, via the communications interface over the network, information regarding the secondary skill-based game to the plurality of game machines, causing the plurality of game machines to display a prompt, via the display of each of the plurality of game machines, allowing the players to choose to participate in the secondary skill-based game, wherein the prompt for the secondary skill-based game is displayed during play of the skill-based game, determine an outcome of the skill-based game being played on each of the plurality of game machines, based on information uploaded to the central office processor by each of the plurality of game machines, including:

interface with a neural network trained to associate probabilities of different outcomes based on a game state, receive, from the neural network, one or more game actions based on the probabilities of the different outcomes, and select a game action to perform from the one or more game actions based on a random factor, update a number of wagering units held by the players based on the outcome of the skill-based game, determine each one of the players entered in the secondary skill-based game based on one or more responses to the prompt displayed on each of the plurality of game machines, determine, for each of the plurality of game machines associated with one of the players entered in the secondary skill based game, an elapsed time that each of the players has played the secondary skill-based game, and if the elapsed time is less than a predetermined time interval, and if a number of wagering units held by at least one player is greater than a predetermined number of wagering units, provide the at least one player with a secondary skill based prize separate from available prizes in the skill-based game.

* * * * *